United States Patent [19]

Watts

[11] Patent Number: 4,723,377

[45] Date of Patent: Feb. 9, 1988

[54] DEVICE FOR CLEANING DRUMS

[76] Inventor: W. David Watts, 1620 Saddleridge Way, Dunwoody, Ga. 30338

[21] Appl. No.: 873,698

[22] Filed: Jun. 12, 1986

[51] Int. Cl.[4] ..... B24C 3/08

[52] U.S. Cl. ..... 51/411; 51/420; 51/424; 51/426; 134/152; 134/153

[58] Field of Search ..... 51/281 P, 410, 411, 51/417, 419, 420, 424, 426, 432, 433, 434; 15/57, 58, 70; 134/134, 152, 153, 166 R, 170; 198/752; 209/920

[56] References Cited

U.S. PATENT DOCUMENTS

| | | | |
|---|---|---|---|
| 3,615,822 | 10/1971 | Molinari | 134/152 X |
| 3,626,641 | 12/1971 | Powell et al. | 51/426 X |
| 3,789,711 | 2/1974 | Mead | 198/752 X |
| 4,018,006 | 4/1977 | Moelders | 51/419 |
| 4,269,003 | 5/1981 | Wolfgang | 51/433 X |

FOREIGN PATENT DOCUMENTS

| | | | |
|---|---|---|---|
| 171777 | 7/1952 | Austria | 134/152 |
| 787493 | 12/1957 | United Kingdom | 51/411 |
| 662334 | 5/1979 | U.S.S.R. | 51/411 |

*Primary Examiner*—Robert P. Olszewski
*Attorney, Agent, or Firm*—William Nitkin

[57] ABSTRACT

A drum-cleaning machine having a casing with an indexing mechanism to move drums therethrough at a 45-degree angle, such indexing mechanism including wheels spinning the drums at stations between such wheels; at least one upper shotblast wheel positioned on the casing above the drum whose shotblast pattern is directed downward and is adapted to clean the bottom and sides of the drum; at least one side-mounted shotblast wheel positioned on the casing aligned with the upper shotblast wheel such side-mounted shotblast wheel's shotblast pattern being directed substantially horizontal and adapted to clean the bottom of each drum and if the drum has an open bottom, is adapted to clean the inner sides and inside of the closed end of the drum.

14 Claims, 2 Drawing Figures

DEVICE FOR CLEANING DRUMS

BACKGROUND OF THE INVENTION

1. Field of the Invention

The apparatus of this invention resides in the area of shot blast machines utilized for cleaning drums and more particularly relates to a workpiece pass-through system for cleaning open-ended drums, barrels and the like by shot blast wheels positioned in the apparatus of this invention.

2. Description of the Prior Art

It is often necessary to clean large numbers of open-ended and closed-end drums typically of the 30-gal, 55-gal and 85 gal size which drums are often utilized for the transportation of foodstuffs or other materials. Thorough cleaning of the drum is especially necessary if the drum is to be reused.

To clean such drums, shotblast techniques have been employed with the drum mounted on a conveyor system and indexed through a machine in a horizontal plane with the drum lying on its side. The horizontally-oriented drums in such machines are moved by drag chains or pushrods and are spun in the blast area on wheels positioned in the conveyor system. A minimum of three blast wheels are provided with the first positioned to propel shot at the front open end of the drum; the second, at the rear end; and the third, on the top of the drum as it passes through the machine. A problem with machines of this type having blast wheels positioned to propel shot in a horizontal plane to the drum opening is that if the horsepower of the wheel exceeds approximately 20 hp, the force of the abrasive blast directly into the drum tends to blow the drum off the roller conveyor system which occurrence disables and jams the entire cleaning machine.

To try to overcome this problem when cleaning drums in the conventional manner in horizontal drum array systems, a pair of guide rails between 6"–12" in height have been provided extending the entire length of the machine which guide rails are disposed at each end of the drum and which guide rails contain and form a channel for the drums to pass therein as they are indexed through the machine during the blast cleaning process. However, if the force of the shot blast stream is too great, these guide rails will not prevent the drums from being blown out over the guide rail due to the drum's relatively light weight.

A further problem that arises in systems in which the drums are horizontally arrayed on their sides is that even though the drums are rotating, abrasive material builds out of the drums because such abrasive material cannot fully drain out of the drums because the sides of the drums are always horizontal. This abrasive material buildup in the drum causes a blinding action to further cleaning since further particles blasted within the drum cannot strike the portion of the drum covered by abrasive material. This abrasive buildup prevents a thorough cleaning of the covered area especially at the chime of the drum where the bottom of the drum meets the sides.

SUMMARY OF THE INVENTION

It is an object of this invention to provide an improved shot blast drum-cleaning machine which utilizes fewer blast wheels than the prior art and eliminates the jamming problems encountered when drums are blown off the horizontal conveyor systems of the prior art.

It is a further object of this invention to provide thorough cleaning of drums, barrels and the like by eliminating abrasive buildup inside the drum which buildup prevents shot from directly striking the drum where abrasive buildup has occurred.

It is yet a further object of this invention to provide a machine having the capability of cleaning drums of different sizes.

The objects of this invention are met by the device of this invention which carries the drums therethrough at a 45-degree angle with the opening of each drum facing downward. In this manner the drums can be cleaned with a minimum of two blast wheels, the first blast wheel positioned aimed down from above, the abrasive blast pattern of which strikes the full side and the exterior of the bottom of the drum as the drum is rotated thereunder and the second blast wheel, the shotblast pattern of which is aimed generally horizontally coming inward from the side, the abrasive blast pattern of which strikes the inside of the drum. As the drum rotates in front of the second blast wheel, a portion of the second wheel's blast pattern overlaps the blast pattern of the first blast wheel further cleaning the outer side of the drum. The bottom of the drum is cleaned by direct hitting of shot to the chime and side wall and also additionally cleaned by ricocheting shot within the drum. In some embodiments additional sets of shotblast wheels can be positioned parallel to the first set for additional cleaning action if desired due to the nature of the material to be cleaned out of the drums or to provide an increased production rate for faster cleaning of the drums. For example, some drums used in the food, paint and oil industries are baked before they are cleaned which encrusts and carbonizes the product residue contained therein which residue must be thoroughly removed before the drums can be reused.

In the device of this invention the drums are moved by a conveying system with each drum's open end facing downward. As the drums enter the apparatus of this invention, they are first tipped at a 45-degree angle and then pushed by a pusher arm into the shotblast area of the device. The drums enter one at a time and rest upon pairs of rotating wheels on each side which wheels can spin the drum at approximately 25 rpm in one embodiment although other speeds can be utilized. A typical residence time may allow the drums to remain for 5 seconds or longer at each station between two pairs of wheels. The drums, when in the shot blast area are struck by shot from above which pins the drum downward against a guide plate. The wheels can be composed of a material that is polyurethane-treated for durability, and the force of the downward pressure of the shot blast from the first shotblast wheel against the bottom and outer side of the drum causes the drum to be pushed against the guide plate which can be made of a manganese steel or equivalent which guide plate prevents the drum from sliding off the polyurethane-treated cast wheels and falling toward the second side-mounted blast wheel. The second side-mounted blast wheel blasts shot generally horizontally into the drum, and its force against the drum is counterbalanced by the force of gravity on the drum pins the drum against the wheel so that the drums are held in position by the action of the blast patterns. When each drum is advanced into the shotblast area by the pusher rod, it pushes each preceding drum against the next preceding drum. Each drum in turn is pushed upwards and out of the pocket or station formed between the parallel sets of wheels and falls into the next pocket between the next adjacent parallel set of rotating wheels for a period of time until the next succeeding drum is entered into the shot blast area wherein each drum of the drum array will be pushed onward to the next station. When the drum passes by the shotblast wheels and is clean, it comes to the end of the shotblast area where it is again positioned with its open end aimed downward on a conveyor which has vibration means built into it which vibrates each drum causing any shot or particulate material that might be in the drum or caught in the chime to fall out of the drum. The drum is then conveyed from the device of this invention for further treatment or use.

The shotblast wheels of this device utilize an auger-type shot return located at the bottom of the shotblast area which return moves the shot to a bucket-type conveyor then upwards to an upper auger which moves the shot to an airwash for cleaning the shot for reuse and then to a shot reservoir where it passes through shot entry tubes back into the respective shotblast wheels for reuse as will be described further below.

DESCRIPTION OF THE PREFERRED EMBODIMENT(S)

Figure 1:
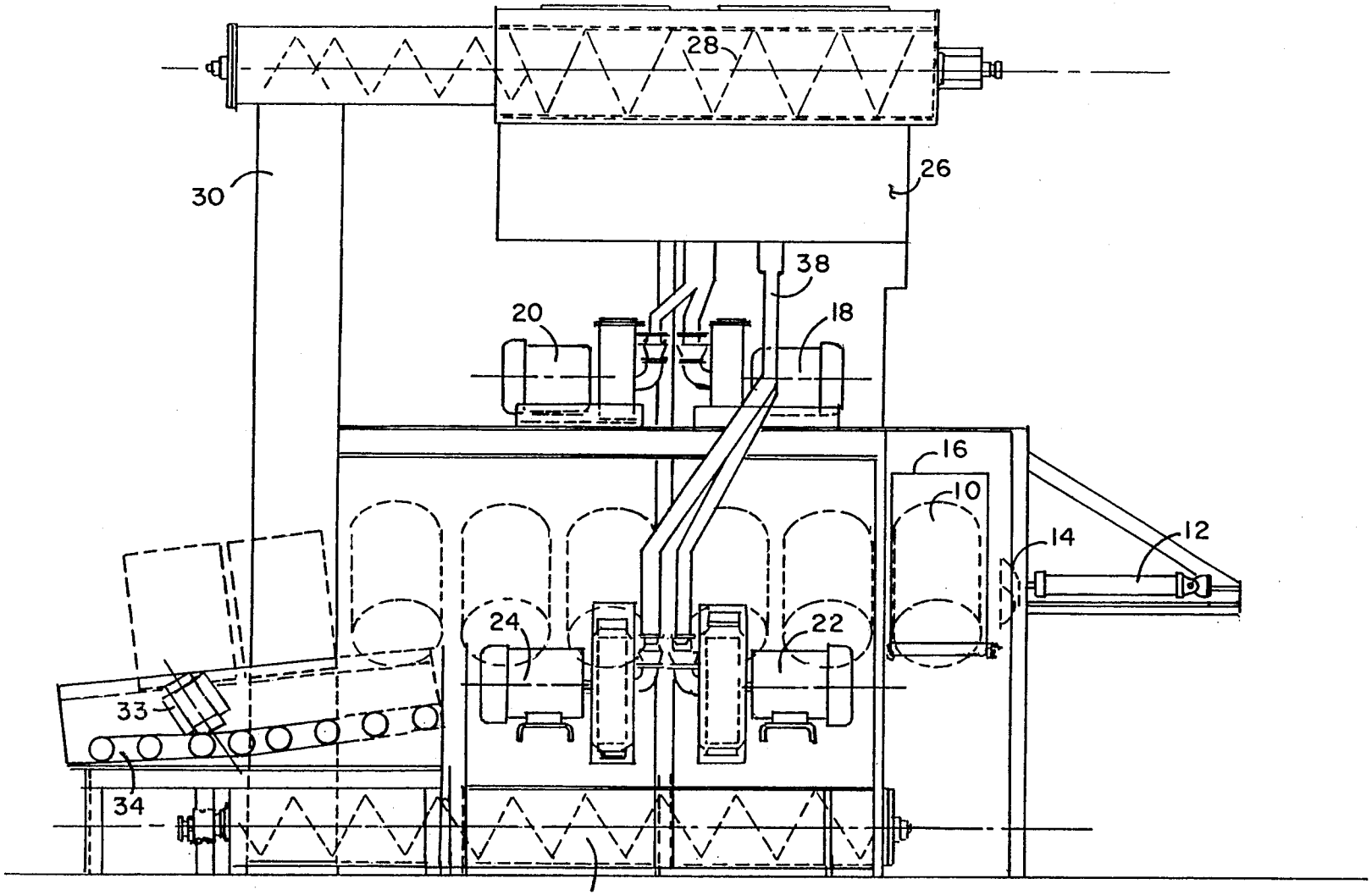
FIG. 1 illustrates a side view of an embodiment of the device of this invention.
Figure 2:
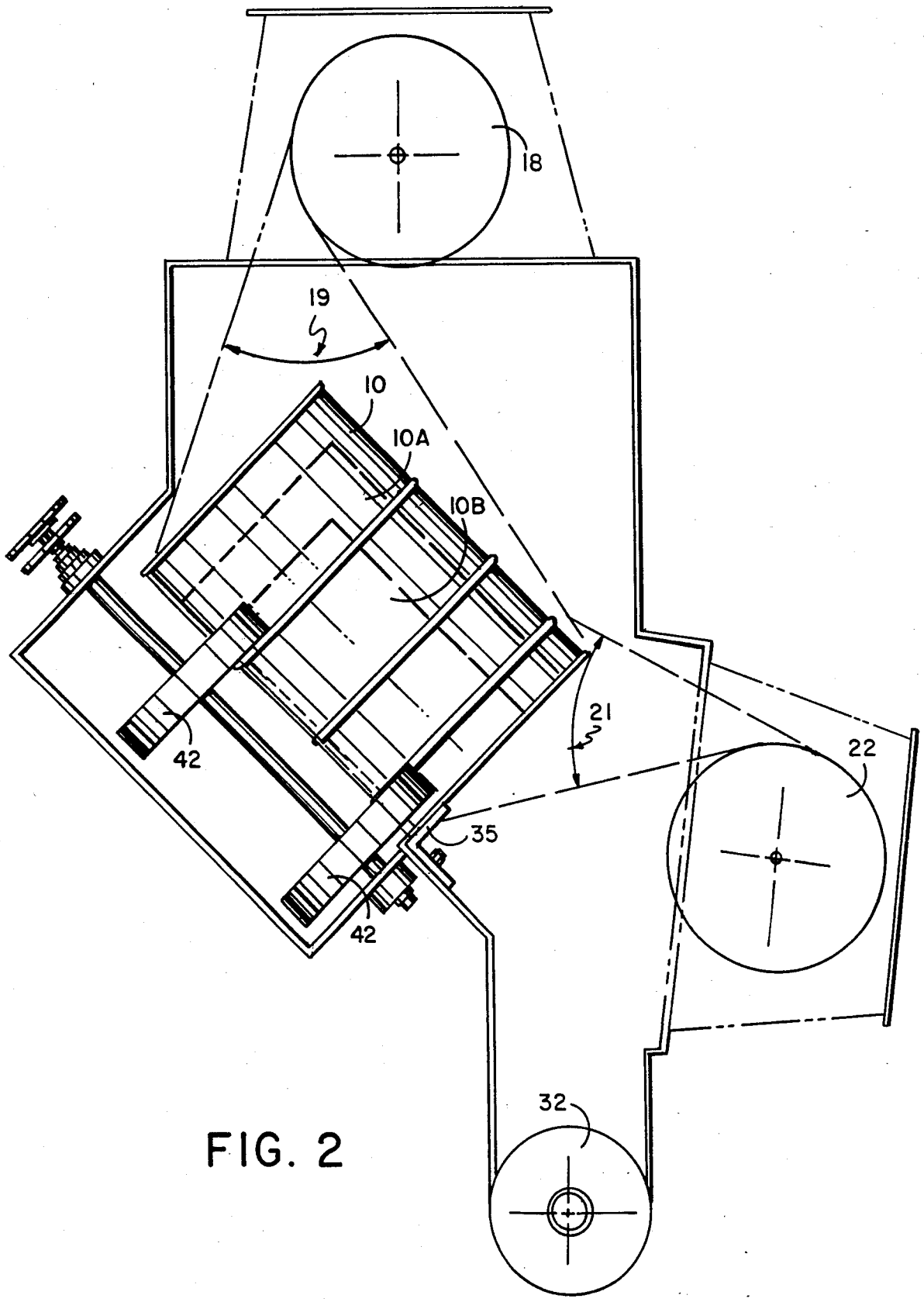
FIG. 2 illustrates an enlarged cross-sectional view through FIG. 1 showing the arrangement of the shotblast wheels and a drum positioned adjacent to a pair of rotation wheels.

FIG. 1 illustrates the device of this invention where entry 16 can be seen in the casing through which drum 10 are advanced with their open ends facing downward. It should be noted that closed-ended drums can also be cleaned by this invention. When the drums pass through entry 16, they are tipped sideways until they come to rest at a 45-degree angle to the vertical upon the rotating wheels 42 as seen in FIG. 2. Piston 12 moves pusher arm 14 to advance each drum into the shotblast area in the casing. As each drum enters, it strikes the next adjoining drum which in turn strikes the next adjoining drum and so on down the line forcing each drum over a pair of rotating wheels to the valley or station formed between two pairs of rotating wheels. These pairs of rotating wheels rotate counterclockwise which in turn rotate the drums in a clockwise fashion which direction of movement of the wheels assists in the advancement of the drums over each pair of rotating wheels. Each drum is pushed upwards by the force of the next succeeding drum pushing against it in series and is also moved over pairs of wheels by friction of the wheels rotating counterclockwise to move the drum to the next station. The drum then falls downward between the next set of rotating wheels and then promptly rotates being spun by the rotating wheels at the speed desired. One rotation speed which has been found to be successful for the cleaning of drums is 25 rpm with a 5 second interval between the entry of new drums into the device of this invention so that each drum remains at each station for approximately 5 seconds at a minimum. The number of stations depends on the number of sets of shotblast wheels with the number of sets of shotblast wheels dictated by the number of drums to be cleaned per hour with each set of shotblast wheels having a drum station aligned therewith.

A key feature of this invention is the placement of the shotblast wheels in relation to the angle of the drum as seen in FIG. 2. Here one can see first shot blast wheel 18 aimed downward with its blast pattern 19 striking the bottom and outside of drum 10. Also seen in second shotblast wheel 22 with its blast pattern 21 striking the outside and inside of drum 10. Stop plate 35 prevents the drum from sliding downward toward second shot blast wheel 22. Drum 10 rotates in position in a valley or station between two pairs of rotating wheels 42 until it is advanced to the next station between the adjacent pair of rotating wheels and the next pair of rotating wheels where it rotates again. In FIG. 2 the second pair of rotating wheels is behind the pair seen on the other side of the drum and therefore not visible in this view. Also seen in FIG. 2 is lower auger 32. Shot return tube 38 from reservoir 26 is seen in FIG. 1 which returns the shot to first shotblast wheel 18 and to second shotblast wheel 22. Other shot return tubes are provided to other shot blast wheels from reservoir 26. It should be noted that although four shotblast wheels are illustrated in FIG. 1, additional pairs of shotblast wheels could be utilized but in the simplest embodiment of this invention first and second shotblast wheels 18 and 22 respectively are the minimum number necessary to clean a drum as long as the drum rotates for a sufficient period of time in front of the shotblast wheels are they propel shot against it. Conventional spent shot return apparatus is seen at 30 to cooperate with the lower auger 32 and upper auger 28 to return shot to the reservoir 26. Drums exiting the last station are received on a conventional vibrating conveyor comprised of structural elements 33 and 34 as is well known in the art.

FIG. 2 also illustrates the feature of the device that drums of different sizes such as smaller drums **10*a* and 10*b* seen in dotted lines can be conveyed through this machine without the necessity of having guide rails adjusted for each size of drum. The open end of the drum rests against plate 35 and if different sized drums are put through the device which are longer in length than the distance between rotating wheels 42, they can be advanced through the device of this invention being struck properly by the blast of the first and second shotblast wheels without the necessity of modifying the apparatus. It should be further noted in the embodiment illustrated in FIG. 2 that second shotblast wheel 22 can be aimed at a slightly upwardly angle such as approximately 7 degrees from the horizontal which positioning helps direct the shot to the chime area of the drum which is the most difficult area to clean and requires the most direct shot action. The bottom of the drum is cleaned by direct and ricocheting shot within the drum. The force of the shot striking downward on the inside wall of the drum not only cleans the drum, but also pins it to the wheels to help hold the drum in place. The fact that plate 35** may block a small part of the bottom opening of the drum does not effect the cleaning of that area since the drum is rotating and any blocked area is later exposed to the shot blast pattern and ricocheting shot as the drum rotates.

Another advantage of the device of this invention is that the blast pattern of each shotblast wheel does not directly aim at the other shot blast wheel so that one shotblast wheel is not damaged by shot from the other shotblast wheel.

It should be noted when using the device of this invention the force of the shot blast from the shotblast wheels holds the drums in position on the rotating wheels. Horsepower of up to 60 hp can be successfully utilized to quickly clean the drums without forcing the drums off the rotating wheels. The device of this invention operates automatically and does not require an operator.

Although the present invention has been described with reference to particular embodiments, it will be apparent to those skilled in the art that variations and modifications can be substituted therefor without departing from the principles and spirit of the invention.

I claim:

1. Apparatus for cleaning surfaces of drums, barrels and like objects including such objects having at least one open end, comprising:

a casing having an entrance opening at a first end and an exit opening at a second end, the openings being sufficiently large to receive therethrough drums to be cleaned;

means disposed within the casing between the openings for defining at least one cleaning station, said station being adapted to receive and mount one of the drums and to maintain the drum in a tilted position with the longitudinal axis of the drum at an angle to the vertical with drums having open ends having said open end disposed downwardly, the cleaning station being defined by two horizontally spaced pairs of at least two vertically spaced rotary wheels, the rotational axes of the spaced wheels being oriented at an angle to the vertical, the pairs of wheels contacting and mounting one of the drums at the cleaning station;

guide plate means joined to the casing at a lowermost point of the cleaning station for maintaining the drum in the station;

means connected to the pairs of wheels for rotating the wheels to cause a drum in the station to spin about its longitudinal axis;

means for feeding the drums sequentially into the cleaning station and for removing said drums from said station;

at least one upper shotblast wheel positioned interiorly of said casing and above said cleaning station and having a shotblast pattern which is directed downwardly toward a drum maintained in the station, shot emanating from the upper shotblast wheel acting to clean exterior surfaces of the drum; and, at least one lower shotblast wheel mounted interiorly of said casing to the side of the cleaning station and facing toward the end of the drum which is tilted upwardly and having a shotblast pattern which is directed substantially horizontally and toward the upwardly tilted end of the drum, shot emanating from the lower shotblast wheel acting to clean at least bottom end surfaces of the drum and interior surfaces of drums having open ends, the upper and lower shotblast wheels being oriented relative to each other such that the shotblast pattern of each wheel is not directed toward the other wheel.

2. The apparatus of claim 1 wherein the drums are positioned in the cleaning station at an angle of 45° to the vertical.

3. The apparatus of claim 1 wherein the first-mentioned means define a plurality of laterally arranged side-by-side cleaning stations, each station being defined by spaces between laterally spaced pairs of vertically spaced wheels, each station sharing at least one spaced pair of wheels, each cleaning station having one of the upper shotblast wheels and one of the lower shotblast wheels arrayed relative thereto.

4. The apparatus of claim 3 wherein the drums are positioned in the cleaning stations at angles of 45° to the vertical.

5. The apparatus of claim 1 wherein the feeding means comprises a pusher arm and a piston, the piston actuating the pusher arm intermittently to push a drum entering the casing through the entrance opening into the cleaning station, the drum so pushed contacting a drum already in the cleaning station to dislodge said drum toward the exit opening.

6. The apparatus of claim 3 wherein the feeding means comprise a pusher arm and a piston, the piston actuating the pusher arm intermittently to push a drum entering the casing through the entrance opening into that cleaning station nearmost the entrance opening, the drum so pushed contacting a drum already in the nearmost cleaning station to dislodge said drum into the next adjacent cleaning station and toward the exit opening.

7. The apparatus of claim 1 wherein the blast pattern of the lower shotblast wheel is aimed at an approximately 7° upward angle from a horizontal plane and into an open end of a drum having an open end.

8. The apparatus of claim 3 wherein the blast patterns of the lower shotblast wheels are aimed at an approximately 7° upward angle from a horizontal plane and into open ends of drums having open ends.

9. The apparatus of claim 1 and further comprising conveyor means for receiving the drum from the station and for removing said drum from said casing.

10. The apparatus of claim 9 and further comprising means for vibrating the conveyor means.

11. The apparatus of claim 1 and further comprising means for returning spent shot to the shot blast wheels for reuse.

12. The apparatus of claim 3 and further comprising conveyor means for receiving one of the drums from the cleaning station nearmost the exit opening and for moving said drum from the exit opening.

13. The apparatus of claim 12 and further comprising means for vibrating the conveyor means.

14. The apparatus of claim 3 and further comprising means for returning spent shot to said shotblast wheels for reuse.

* * * * *